United States Patent [19]

Kieferle

[11] 4,036,482

[45] July 19, 1977

[54] APPARATUS FOR HARDENING WORKPIECES OF STEEL

[75] Inventor: Wolfgang Kieferle, Ravensburg, Germany

[73] Assignee: Hawera probst Kommanditgesellschaft Hartmetall-Werkzeugfabric Ravensburg, Ravensburg, Germany

[21] Appl. No.: 711,481

[22] Filed: Aug. 4, 1976

Related U.S. Application Data

[62] Division of Ser. No. 559,247, March 17, 1975.

[30] Foreign Application Priority Data

Mar. 18, 1974 Germany ..... 2412982
Dec. 5, 1974 Germany ..... 2457605

[51] Int. Cl.[2] ..... C21D 1/06
[52] U.S. Cl. ..... 266/252

[58] Field of Search ..... 148/16, 16.5; 266/251, 266/252, 254, 257–259

[56] References Cited

U.S. PATENT DOCUMENTS

| | | | |
|---|---|---|---|
| 2,237,966 | 4/1941 | Koehring | 266/252 |
| 2,240,146 | 4/1941 | Ness | 14/16.5 |
| 2,398,012 | 4/1946 | Kiser | 148/16.5 |

*Primary Examiner*—Gerald A. Dost
*Attorney, Agent, or Firm*—Walter Becker

[57] ABSTRACT

An apparatus for hardening a workpiece of steel, according to which the workpiece is heated, for instance in a furnace, to austenitizing temperature and is carburized by a pressurized mixture of purified air and propane surrounding the workpiece, whereupon the workpiece is quenched in a cooling region.

9 Claims, 8 Drawing Figures

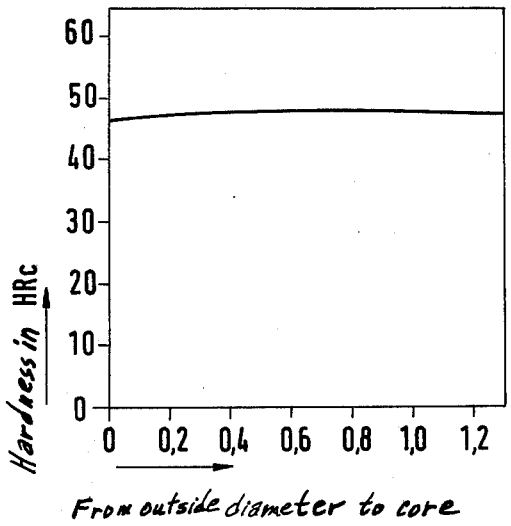
Fig.7
Fig.8
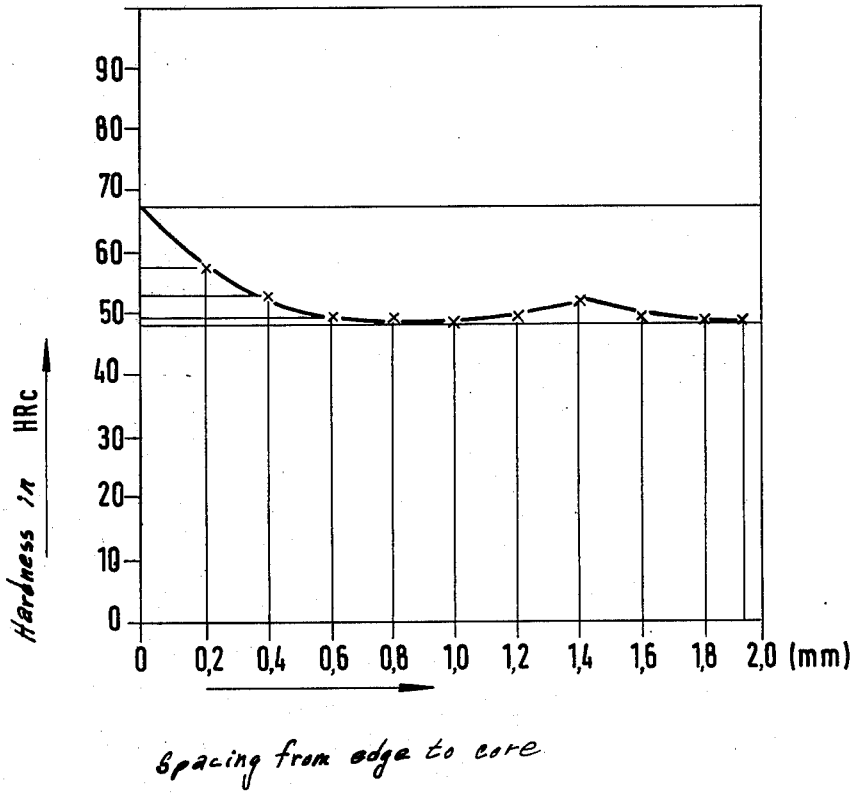

APPARATUS FOR HARDENING WORKPIECES OF STEEL

This is a divisional application based on co-pending parent application Ser. No. 559,247-Kieferle, filed Mar. 17, 1975.

The present invention relates to an apparatus or device for hardening workpieces of steel, according to which the workpieces is, for instance, heated in a furnace and is carburized by a carburizing medium and is subsequently quenched within a cooling region. With workpieces, especially with aantiwear parts, frequently a hard surface layer is desired. To this end, the workpieces are according to a heretofore known method, passed on a conveyor belt through a pass-through furnace which is supplied with a gaseous carburizing medium, for instance, a mixture of air and propane, which is heated to a corresponding high temperature. The propane disintegrates at these temperatures partially at the surface of the workpiece while carbon is freed which diffuses into the workpiece. In this way, the marginal layer of the workpiece is enriched with carbon and when leaving the furnace will have the carbon concentration necessary for the desired hardness. Immediately after leaving the furnace, the carburized workpiece is quenched in water, oil, air or a hot bath which form the hardening constituents proper. Subsequently, the workpiece is cooled off in the air. The workpieces will then have the desired surface hardeners. With certain workpieces, especially anti-wear elements, it is endeavored to increase the hardness of the surface layer as high as possible in order thereby also to increase the useful life span of the workpiece.

It is, therefore, an object of the present invention to provide an apparatus for hardening of work pieces of steel of the above mentioned general type which will make it possible to adjust the hardness of the surface layer higher than it is possible with heretofore known hardening methods.

This object and other objects and advantages of the invention will appear more clearly from the following specification, in connection with the accompanying drawings, in which:

FIG. 7 illustrates by way of a graph, the course of the hardness over the diameter of a core-hardened 34 CrNiMo 6-steel.

FIG. 8 illustrates by way of a graph the course of the hardness over the diameter of a 34 CrNiMo 6-steel after a core hardening in combination with a surface hardening.

The method according to the present invention is characterized primarily in that the carbon medium consists primarily of a gas mixture of purified air and propane surrounding the workpiece under pressure.

According to the present invention, the workpieces to be hardened are on a conveyor belt passed through the furnace. The furnace is supplied with a gas mixture of purified air and propane, which gas mixture is under pressure. Thereupon, the gas mixture is in said furnace heated up to the corresponding austenitizing temperature. The speed at which the material to be hardened passes through the furnace, the said material is heated to the austenitizing temperature. During this process a portion of the propane disintegrates at the surface of the material to be hardened while carbon is freed which diffuses into the material to be hardened. After the material leaves the furnace, the said material is quenched. By means of this gas mixture, a surface hardness can be reached which is considerably higher than the heretofore obtainable hardness values. Thus, for instance, the hardness at the surface of a 34 CrNiMo 6-steel which was hardened according to the present invention is approximately 69 HRc, whereas the heretofore abtainable hardness value for this 34 CrNiMo 6-steel is at a maximum 57 HRc.

According to a further development of the present invention, the quenching is effected in a gas mixture of purified air and propane. The material to be hardened which is carburized in the above described manner is subsequently passed into the cooling region. The gas mixture of purified air and propane has in this cooling region a lower temperature than in the furnace so that material to be hardened when entering said cooling region will be quenched by the gas mixture. By carburizing in the gas mixture of purified air and propane and by quenching in the same gas mixture, it is possible in addition to a surface hardening also to carry out a core hardening as well as a core hardening in combination with a surface hardening. When the hardened material has thus been heat treated, a post treatment such as a hardening and tempering, or the like, will no longer be necessary. The workpieces can thus be heat treated in a simple manner without expensive devices or installations and no lengthy operation are necessary so that an expedient and economical operation will be possible.

The invention furthermore concerns a device for carrying out the hardening of workpieces of steel, according to the invention. This device is characterized primarily by a furnace and a subsequent cooling region preferably in the form of a passage, while in the furnace and in the cooling region there is provided a conveyor, the speed of which, is variable preferably by an infinitely variable transmission and by which conveyor the path of the workpiece within the furnace is determined, said furnace having a furnace chamber with at least one gas retort.

Figure 1:
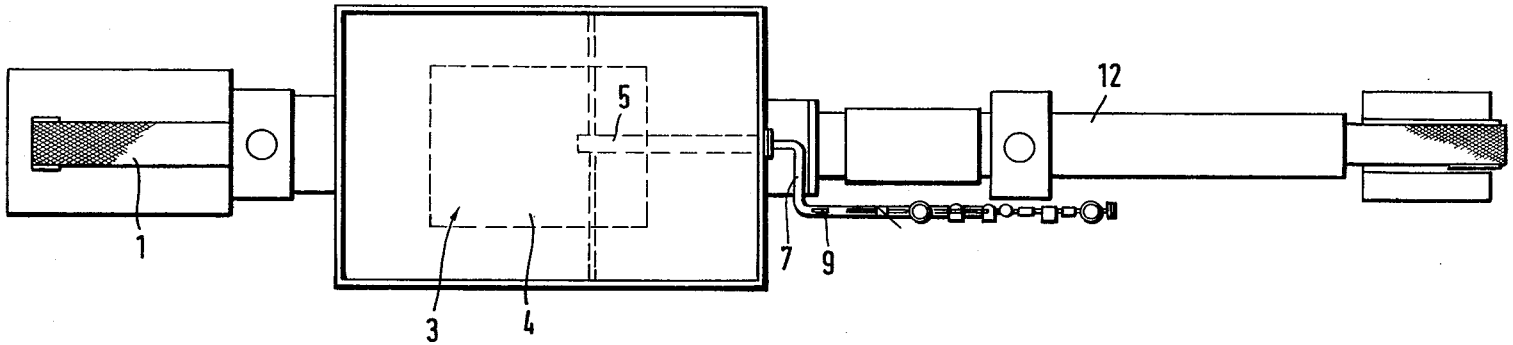
FIG. 1 represents a top view of the device or apparatus according to the present invention.
Figure 2:
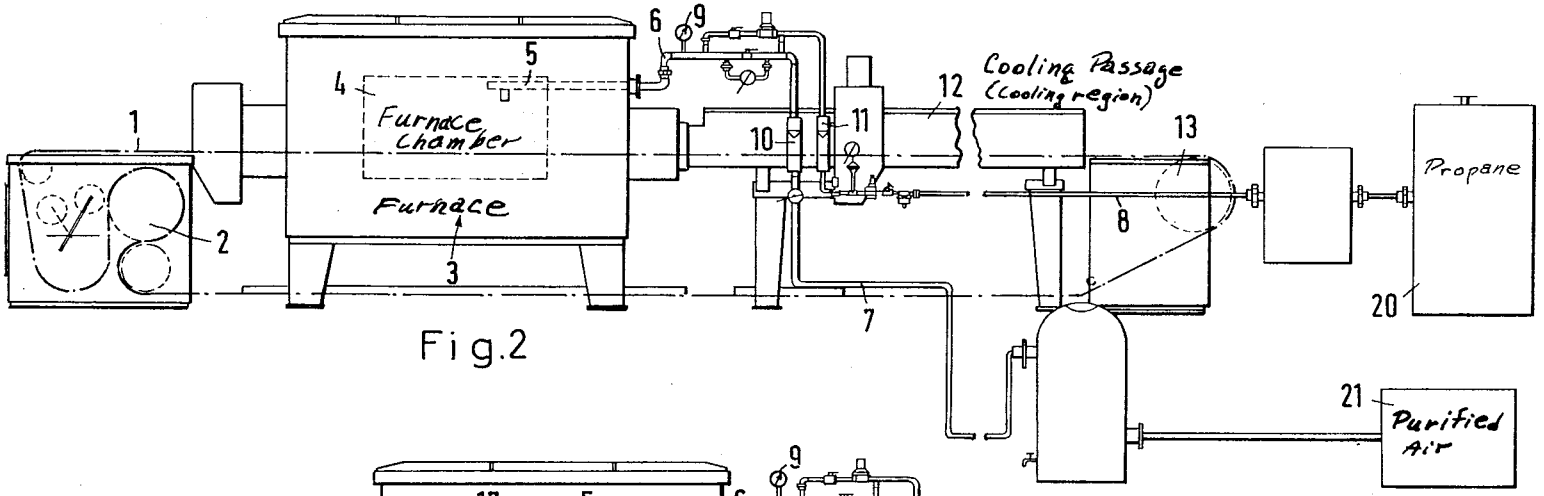
FIG. 2 is a side view of the device or apparatus shown in FIG. 1.
Figure 6:
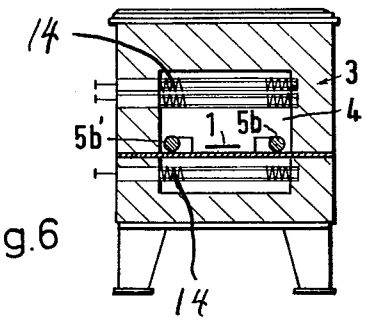
FIG. 6 is a cross section through the device of FIG. 4. said section being taken along the line VI—VI of FIG. 5.

Referring now to the drawings in detail, FIGS. 1 and 2 show a device according to the present invention, which latter for carrying out the hardening of workpieces of steel according to the present invention comprises a conveyor including an endless belt extending over the entire length of the device. The conveyor belt 1 conveys the workpieces to be hardened through the device. The speed of the belt can be varied by means of a change gear transmission 2 which is provided at the start of the conveyor path for the conveying belt 1. The conveying belt 1 first passes through a furnace 3 having a furnace chamber 4 with heating coils 14 therein (FIG. 6). In the furnace chamber 4 above the conveyor belt 1 and slightly below the ceiling of the furnace chamber 4 there is provided a gas retort 5 which extends horizontally with regard to the conveyor belt 1. By means of said gas retort 5, the gas mixture is introduced into the furnace 3. The purified air necessary for the gas mixture and the propane are through separate conduits 7 and 8 passed from supply containers 20, 21 to a main conduit 6, which latter is directly connected to the gas retort 5. In this main conduit 6 there is provided a gas pressure gauge 9 on which the respective gas pressure or the gas mixture to be introduced can be read. The quantity of the two gas components and thus the mixing ratio can be controlled by means of through-flow meters 10, 11. The furnace 3 is followed by a cooling region in the form of a cooling passage 12. The conveyor belt is guided in the cooling region which is approximately twice as long as the furnace 3. The cooling passage 12 is open at its free end so that heat-treated workpieces can drop from the conveyor belt 1 into containers placed at the end of the conveying path. At the end of the cooling passage 12, the conveyor belt 1 passes over a reversing roller or drum 13.

Figure 3:
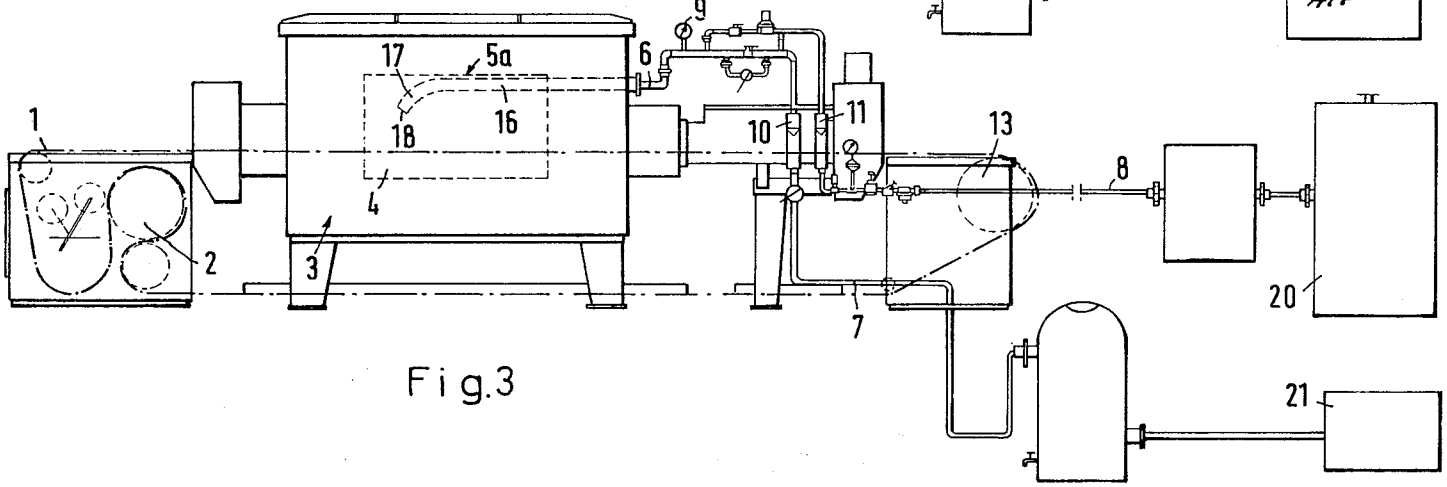
FIG. 3 is a side view of a modified device according to the invention.

With the embodiment according to FIG. 3, the gas retort 5*a* comprises a horizontally extending section 16 followed by an end piece 17 which is directed toward the conveyor belt 1 passing through the furnace chamber 4. This end piece 17 can, together with the horizontal section 16 of the gas retort 5*a*, form an angle of from 1° to 45°. The magnitude of said angle depends on the desired concentration of carbon in the workpiece, and further depends on the proportion of the propane in the gas mixture, and furthermore depends on the gas pressure and/or the size of the workpiece. The outlet opening 18 of the gas retort 5*a* is only slightly spaced from the workpiece on the conveyor belt 1. Due to the curved end piece 17, the gas mixture leaving the gas retort 5*a* directly impacts upon the workpieces which pass on the conveyor belt 1 through the furnace chamber 4.

The more precisely the end piece 17 of the gas retort 5*a* is directed in the direction toward the workpiece in the furnace chamber 4, in other words, the shorter the distance between the outlet opening 18 and the workpiece surface, the more intensive will the introduced gas mixture be able to react with the workpiece so that the proportion of the gas mixture which does not contact the workpiece can be reduced to a minimum. The end piece 17 of the gas retort 5*a* can advantageously through a non-illustrated connecting member be connected with the straight retort section 16 so that depending on the desired conditions for carrying out the method, differently curved end pieces 17 can be quickly connected to the retort section 16.

Figure 4:
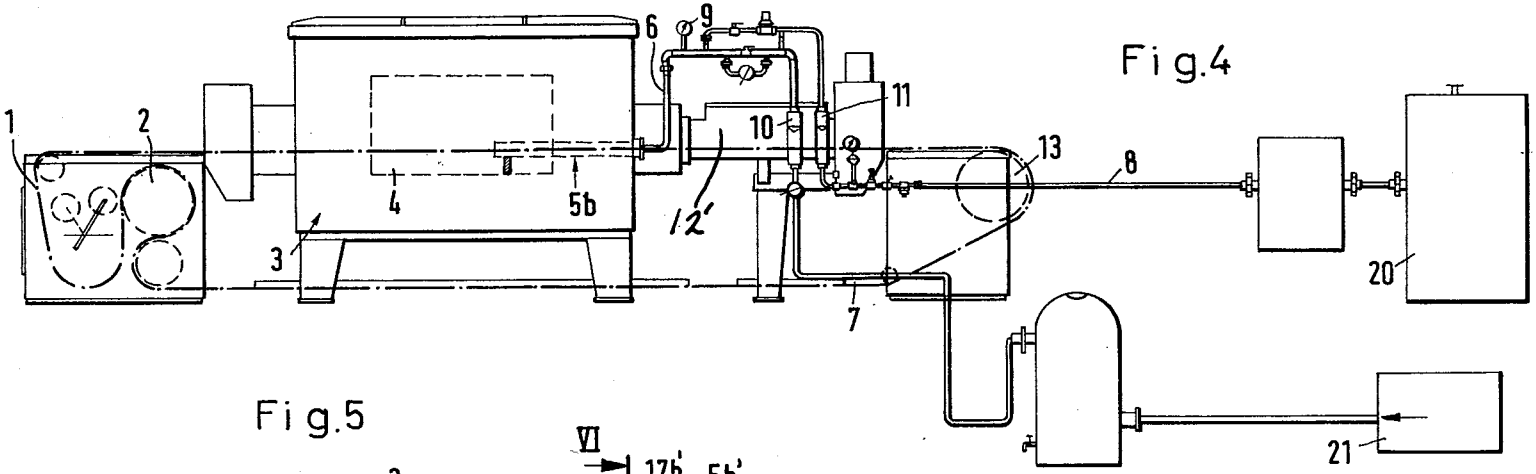
FIG. 4 is a side view of still another device according to the invention.
Figure 5:
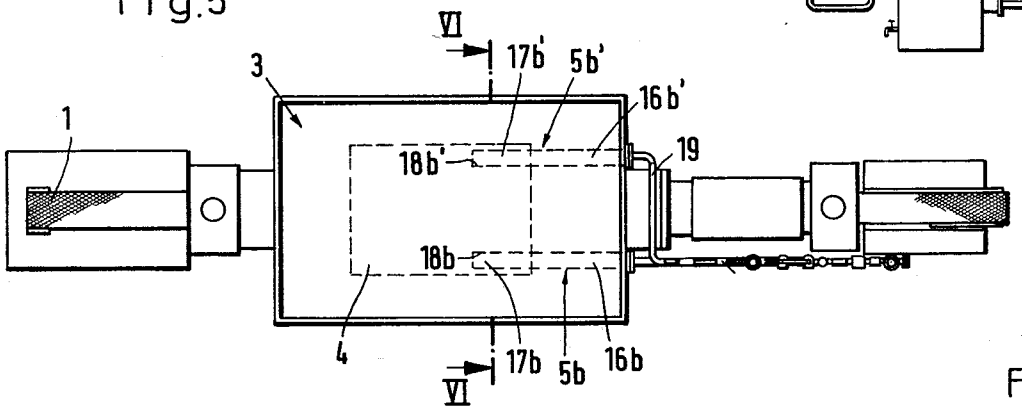
FIG. 5 is a top view of FIG. 4.

With the embodiment of FIGS. 4–6, two gas retorts 5*b* and 5*b*′ spaced from each other lead into the furnace chamber 4. The gas retorts 5*b* and 5*b*′ have the same length and are located in the same horizontal plane. The outlet openings 18*b* and 18*b*′ of the two gas retorts 5*b* and 5*b*′ are located in a plane which is approximately perpendicular to the longitudinal axis of the conveyor belt 1. Due to this design and arrangment of the gas retorts it will be assured that the workpiece to be treated in the furnace chamber 4 will be uniformly surrounded by the gas mixture. The two gas retorts 5*b* and 5*b*′ respectively are located on the sides of the conveyor belt 1, preferably at the same height as the latter and extend parallelly with regard to the longitudinal axis of said conveyor belt 1. The outlet openings 18*b* and 18*b*′ are located on that side of the gas retorts 5*b*, 5*b*′ which faces toward the conveyor belt 1 so that a direct gasification of the workpieces on the conveyor belt 1 will be possible. The outlet openings 18*b* and 18*b*′ may also be provided at the end of the gas retorts 5*b* and 5*b*′. The ends of the gas retorts are so inclined or beveled that the gas mixture leaving the gas retorts directly impacts upon the workpieces. Due to the slight distance between the outlet openings 18*b* and 18*b*′ and the workpiece on the conveyor belt 1 it will also with this embodiment be assured that nearly the total gas mixture introduced into the furnace chamber 4 will come into contact with the workpiece. For a uniform gasification of the furnace chamber 4, it is advantageous when each gas retort comprises a plurality of outlet openings directed toward the conveyor belt 1.

It is, of course, also possible so to design the gas retorts 5*b* and 5*b*′ that the end pieces 17*b* and 17*b*′ are directed toward the conveyor belt 1. The two gas retorts are preferably supplied with the gas mixture through a common conduit 19. The workpieces need not be deposited on the conveyor belt. Thus, for instance, when workpieces are involved which may warp or distort, they can also be passed in suspended position through the furnace chamber, in which instance the device according to the invention likewise assures a maximum exploitation of the introduced gas mixture.

With this design of the gas retort according to FIGS. 3–6, the workpiece to be treated can be directly gasified. In view of the only slight distance between the exit opening 18, 18*b*, 18*b*′ of the gas retort 5*a*, 5*b*, 5*b*′ and the workpiece, nearly the entire introduced quantity of gas can act upon the workpiece so that with the same carbon potential in comparison to heretofore known devices with retorts, the outlet opening which has a greater distance from the conveyor can form a considerably higher carbon concentration in the workpiece. The carbon potential of the introduced gas mixture therefore can be lower than when employing the device according to FIGS. 1 and 2. Since when employing the device according to FIGS. 3–6, between the outlet opening 18, 18*b*, 18*b*′ of the gas retort 5*a*, 5*b*, 5*b*′ and the workpiece surface due to the above mentioned only slight distance no carbon monoxide layer which forms during the reaction of the gas mixture will be located on the workpiece surface, the carbon concentration in the workpiece cannot be falsified. Therefore, the carbon concentration in the workpiece precisely reflects the condition of the gas atmosphere so that a better control of the gas atmosphere in the furnace chamber 4 will be possible. The cooling region adjacent the furnace 3 can, due to the maximum exploitation of the carbon content of the introduced gas mixture be shorter than the cooling region of the device according to FIGS. 1 and 2 so that the entire device will do with a reduced adjusting surface.

In order to carry out a core hardening, the workpieces which with this embodiment consist of 34 CrNiMo 6-steel with a diameter of approximately from 6 to 10 millimeters are placed at the start of the device onto the conveyor belt 1. The velocity at which the workpieces are passed through the furnace 3 and the cooling passage 12 depends on the workpiece and a quantity of gas and in the specific embodiment amounts to 240 millimeters per minute. Through the retorts 5, 5*a*, 5*b*, 5*b*′ the gas mixture consisting of purified air and propane at a volumetric ratio of 1:1 is introduced into the furnace 3 at a certain pressure which depends on the hardness to be obtained and the furnace size, said pressure varying approximately from 300 millimeters to 700 millimeters water column. In the specific example referred to, a pressure of 300 millimeters water column is selected. The air is so purified that it consists only of a mixture of oxygen and nitrogen or compounds of the two elements. The degree of purity of the air amounts to approximately 20 ppm at a maximum diameter of the impurity particles of approximately 3 u. In the specific embodiment, the gas mixture passes from the furnace 3 into the cooling passage 12 until also the latter is completely filled with the gas mixture. It is also possible to introduce a gas mixture of purified air and propane through a separate conduit into the cooling passage 12. The gas mixture is then brought to the desired quenching temperature. The gas mixture is, in the furnace 3, heated by heating coils 14 to an austenitizing temperature of between 1120° C and 1140° C. This temperature is of importance because in this way a hardening and soldering will be possible in one and the same working cycle without the necessity of having to employ an additional gas. With the specific example set forth above, the austenitizing temperature is about 1140° C. In the starting range of the cooling passage 12, the gas mixture has cooled off already to such an extent that it has only a temperature of from approximately 800° C to 900° C, which temperature still further decreases in the direction toward the rear end of the cooling-off passage 12.

When the furnace 3 and the cooling-off passage 12 are filled with the gas mixture, and the corresponding temperature has been reached, the workpieces are moved into the furnace 3. The workpiece will be annealed in this gas atmosphere. The propane which at this mixing ratio is excessive, will disintegrate at these high temperatures at the workpiece surface while carbon will be freed which diffuses into the workpiece. In this gas atmosphere, also methane is formed from which the reaction at the workpiece surface, partially hydrogen, is split off. As tests have shown, the hydrogen as well as the methane have in these small occurring quantities thereof no influence on the hardening process. The gas composition in the furnace chamber can be controlled by means of the dew point. In order to obtain optimum conditions, the dew point should amount to from −4° C to −7° C. From the furnace 3 in which the 34 CrNiMo 6-steel was annealed for approximately five minutes, the workpiece moves into the cooling-off passage 12. When entering said cooling-off passage, the workpiece is quenched from the austenitizing temperature of 1140° C in the furnace 3 by the gas mixture to approximately of from 800° C to 900° C. The quenching speed can be controlled by the gas quantity and gas pressure. The quenching speed is so selected that the intermediate stage will be directly obtained. The workpiece subsequently slowly passes through the cooling-off passage 12 and while doing so is continuously surrounded by the gas mixture. In the specific embodiment referred to, the staying time in the cooling-off passage is from about 12 to 15 minutes. At the end of the passage, the workpieces will drop into containers placed at the end of said passage.

As metallographic tests have shown, the heat-treated workpiece has a tempered martensitic texture, which is interspersed with intermediate stage texture. This type of texture is characteristic for the described hardening method. The course of the hardness as it is obtained with the described heat treatment is illustrated in FIG. 7 in comformity with the workpiece diameter. The hardness is stated in Rockwell and from the core to the outer layer of the 34 CrNiMo 6-steel has a constant value of approximately 48 HRc.

This core hardening of the workpiece is brought about by the poor heat conductivity of the gas mixture. In this way, the heat will be prevented from passing from the furnace wall to the workpiece so that the heat radiation can be kept to a minimum. Simultaneously, the gas mixture cools the workpiece.

In order to be able to carry out a surface hardening in combination with a core hardening, it is necessary to increase the gas pressure and thereby the gas quantity. As a result thereof, at the workpiece surface is the furnace 3, more free carbon will form so that also a higher surface hardening can be obtained. In this connection, for each steel a certain gas pressure exists up to which the core and surface will have the same heat values. If this pressure is exceeded, only an increase in the surface hardness is obtainable.

With the above embodiment, the gas pressure was increased from 300 millimeters water column to 400 millimeters water column. The course of the hardness is the same as described above. The hardening course obtained in this connection is illustrated in FIG. 8. The hardness of the core lies approximately at 48 HRc, in other words, the same as with the core hardening. The hardness at the surface of the workpiece has, however, greatly increased. It now has a value of approximately 69 HRc and thus is considerably higher than the heretofore hardening value for this 34 CrNiMo 6-steel which amounts to a maximum of 57 HRc. This hard surface has approximately a layer thickness of 0.6 millimeters, the high hardness of which, is created by a pure cementite phase.

Heretofore known methods for core and simultaneous surface hardening are in comparison to the above described invention time consuming and require considerable labor. Thus, the workpieces have to be inserted for a longer period of time into a salt bath and subsequently a martensitic hardening has to be carried out. This is followed by a tempering in order to reduce the brittleness of the workpieces. Due to the various working cycles, an economical operation can be realized only under difficulties. With the described apparatus according to the invention, it is surprisingly possible with a hard core to produce an even harder surface layer. It is disadvantages that with the heretofore known methods in most instances, an oil bath is required as hardness former whereby the plants or machinery for carrying out the method becomes rather expensive. Moreover, a considerable space is required.

For carrying out a surface hardening, the workpieces are, in the furnace 3, again heated up in a gas mixture of purified air and propane to the austenitizing temperature of approximately from 1120° C to 1140° C. Subsequently, the workpieces are quenched preferably in the gas mixture of purified air and propane. By means of the method according to the invention, the surface hardness can be increased beyond the heretofore obtainable values. In the embodiment of the present invention, for a 34 CrNiMo 6-steel, a hardness was obtained of 69HRc, whereas the heretofore obtainable maximum value of hardness for this steel merely lies at 57 HRc.

By changing the pressure, the belt speed, and the concentration of the gas mixture, different hardness values can be obtained, for instance, an increase in hardness can be realized by increasing the pressure. Moreover, in the same manner it can be determined whether, for instance, a core hardening or a core hardening with simultaneous surface hardening is to be obtained. A great advantage of the apparatus according to the invention is seen in the fact that the time for carrying out the hardening of workpieces of steel is considerably shorter than with heretofore known methods. As a result thereof, a greater number of workpieces can be hardened per time unit which means that a considerable reduction in costs can be realized.

Whereas with heretofore known methods during the core hardening the workpiece is in an awkward manner first heat treated in a salt bath and then in conformity with the desired hardness is quenched in oil or water and subsequently for eliminating stresses due to hardness has to be tempered, only one working cycle is necessary for the core and or surface hardening according to the invention. The material to be hardened is placed at the start of the device onto the conveyor belt and at the end of the device drops in finish heat-treated condition into containers placed at the end of the device. Due to the elimination of special hardness formers such as oil bath, water baths, or hot baths, the device according to the invention employed for this method is simple in construction and is considerably less expensive to build than the devices for the heretofore known methods. Moreover, it has been found surprisingly that with the new apparatus heretofore unobtainable hardness values can be obtained with a tempered base texture.

It is, of course, to be understood that the present invention is, by no means, limited to the specific showing in the drawings, but also comprises any modifications within the scope of the appended claims.

What I claim is:

1. An apparatus for hardening a workpiece of steel, which includes: a furnace comprising a furnace chamber, at least one gas retort extending into said furnace chamber for introducing a pressurized gas mixture of purified air and propane into said furnace chamber, said furnace chamber having an inlet and an outlet, a cooling section adjacent said outlet, endless conveyor means extending through said furnace and its furnace chamber and also through said cooling section for receiving workpieces to be hardened and carrying the same through said furnace chamber and said cooling section and subsequently discharging the cooled hardened workpieces, and adjustable transmission means associated with said conveyor means for setting and varying the speed of said conveyor means.

2. An apparatus according to claim 1, in which said at least one gas retort has an outlet opening approximately at the level of that section of said endless conveyor means which is intended to support the workpieces to be hardened when the latter are in said furnace chamber.

3. An apparatus according to claim 2, in which said at least one gas retort includes an exchangeable end section comprising said outlet opening and being directed toward said conveyor means.

4. An apparatus according to claim 3, in which said end section is curved toward said conveyor means.

5. An apparatus according to claim 3, in which said at least one gas retort comprises a substantially straight section having said end section arranged thereon.

6. An apparatus according to claim 5, in which said end section forms with said straight section an angle of from 1° to 45°.

7. An apparatus according to claim 1, which includes two gas retorts respectively arranged laterally and on opposite sides of said conveyor means.

8. An apparatus according to claim 7, in which said gas retorts are located at approximately the level of that section of said conveyor means which is intended to carry the workpieces to be hardened when the latter are in said furnace chamber, said gas retorts extending in the longitudinal direction of said conveyor means.

9. An apparatus according to claim 7, in which said two gas retorts have outlet openings located in a plane approximately perpendicular to the longitudinal direction of said conveyor means.

* * * * *